US006907989B2

(12) United States Patent
Ho

(10) Patent No.: US 6,907,989 B2
(45) Date of Patent: Jun. 21, 2005

(54) TOOL BAG

(76) Inventor: Cheng-I Ho, PO Box 82-144, Taipei (TW)

( * ) Notice: Subject to any disclaimer, the term of this patent is extended or adjusted under 35 U.S.C. 154(b) by 78 days.

(21) Appl. No.: 10/383,728

(22) Filed: Mar. 10, 2003

(65) Prior Publication Data

US 2004/0178100 A1 Sep. 16, 2004

(51) Int. Cl.[7] ..... B65D 85/28
(52) U.S. Cl. ..... 206/373; 383/40
(58) Field of Search ..... 206/372, 373, 206/349; 224/583, 682; 383/39, 40, 4

(56) References Cited

U.S. PATENT DOCUMENTS 4,598,803 A * 7/1986 Ghiassi ..... 190/8
6,390,348 B1 * 5/2002 Godshaw et al. ..... 224/674
D482,196 S * 11/2003 Cabrera et al. ..... D3/228
6,702,168 B2 * 3/2004 Panosian ..... 224/583
6,766,881 B2 * 7/2004 Carty ..... 182/129

* cited by examiner

*Primary Examiner*—Shian T. Luong
(74) *Attorney, Agent, or Firm*—Rosenberg, Klein & Lee

(57) ABSTRACT

An improvement of a tool bag is disclosed. The tool bag comprises a main tool pocket, a secondary tool pocket, a folded pad and an adjustable back pocket. The two pockets are mounted in front of the tool bag and are provided with zippers to enclose the tools within the tool bag. The folded pad can be extended to provide a support to the user when the user's back is lying against the floor.

3 Claims, 9 Drawing Sheets

TOOL BAG

BACKGROUND OF THE INVENTION (a) Technical Field of the Invention

The present invention relates to an improvement of a tool bag, and in particular, tool bag with a primary tool pocket and a secondary tool package, and the tool bag can be put onto the waist or the side of the worker.

(b) Description of the Prior Art

The maintenance department of a manufacturing plant is generally provided with a tool room, which keeps all tools for use in maintenance. A technician needs to come to the maintenance room to get the essential tools for a specific project. However, some tool bags available in the market may not allow all the tools to be placed within the tool bags due to the various sizes of the tools.

FIG. 1 is a conventional tool bag having a cavity of appropriate size and along the edge of the opening, a plurality of holes are provided for a cord to pass through and the cord is used to pull the lugs of the tool bag. Due to the limited space of the tool bag, small tools within the bag may not be easily found.

FIG. 2 is another conventional tool bag having an appropriate size. A plurality of holding pockets are mounted at the sides of the tool bag for the holding of different tools. A zipper is provided to the opening of the pockets so that the pockets can be closed to prevent tools from accidentally drop out from the tool bag. The drawbacks of this conventional tool bag are that long handle tools may not be easily kept in the tool bag. Accordingly, it is an object of the present invention to provide an improvement of a tool bag which can mitigate the drawbacks of the conventional tool bag.

SUMMARY OF THE INVENTION

Accordingly, it is an object of the present invention to provide a combination tool bag comprising a main tool pocket having two bottom end and having a plurality of tool holding slots for holding tools, such as pliers, hammers, wrench, etc the bottom at the center of the pocket provided with a hook for a retractable measuring tape, and an inverted T-shape hook being positioned at a side of the hook having an end portion being positioned at the pocket using a rivet, the inverted T-shape hook used for holding a rubber roll, and the left upper end of the pocket being a hook section and a VELCRO having one end mounted to the pocket, the back section of the pocket provided with a space being formed by fabric extended from the pocket and secured using rivets, the bottom section of the pocket being provided with a pocket pad which is a flat plate having one face thereof being fastened to the pocket using a VELCRO, and a zipper being provided to three side edges of the pocket; a secondary holding pocket having a plurality of holding slots, and the right upper end of the pocket being a hook section and the left upper end being a VELCRO, wherein one end of the VELCRO is fabricated within the pocket body, and the pocket is provided with a space which is formed from the front of the pocket to the rear face of the pocket and a plurality of rivets are used for mounting, the three lateral sides of the pocket are provided with a zipper, and a folding pad being a wide flat pad having one surface provided with a plurality of VELCRO tape, and the two lateral sides being provided with a zipper, an adjustable back pocket having two end hook portions to hook the hook portion of the two tool pockets to obtain a tool bag which can be placed at the side of the user.

Yet a further object of the present invention is to provide an improvement of a tool bag, wherein the main tool pocket and the secondary tool pocket are combined to form a two plate body with the tool holding slots facing out, and the two ends of the bag is adjusted for mounting to a user at the waist.

Still another object of the present invention is to provide an improvement of a tool bag, wherein the folded pad is elongated and the pad is provided with a plurality of VELCRO tape.

Another object of the present invention is to provide an improvement of a tool bag, wherein the tool holding slots are arranged differently to hold tools.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
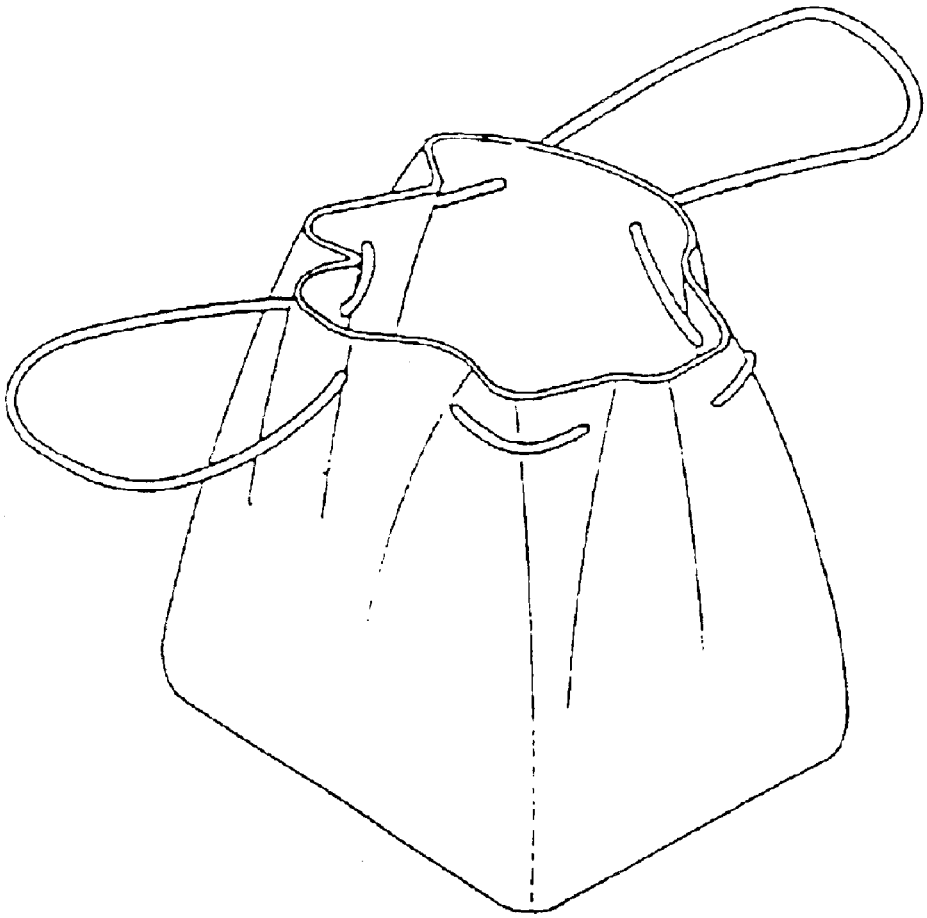
PRIOR ART FIG. 1
FIG. 1 is a perspective view of a conventional tool bag.
Figure 2:
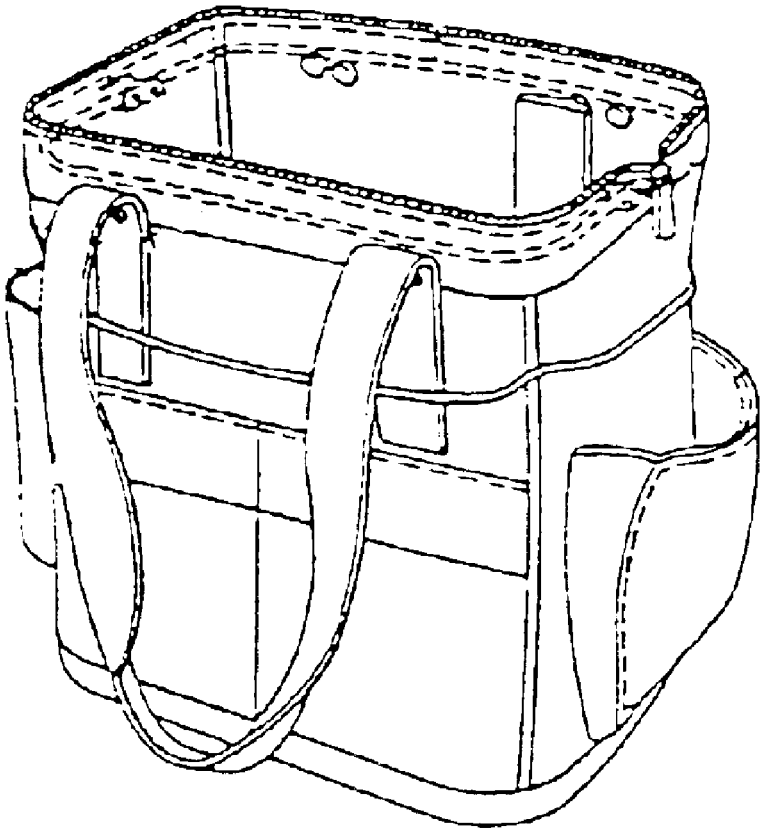
PRIOR ART FIG. 2
FIG. 2 is another perspective view of the conventional tool bag.
Figure 3:
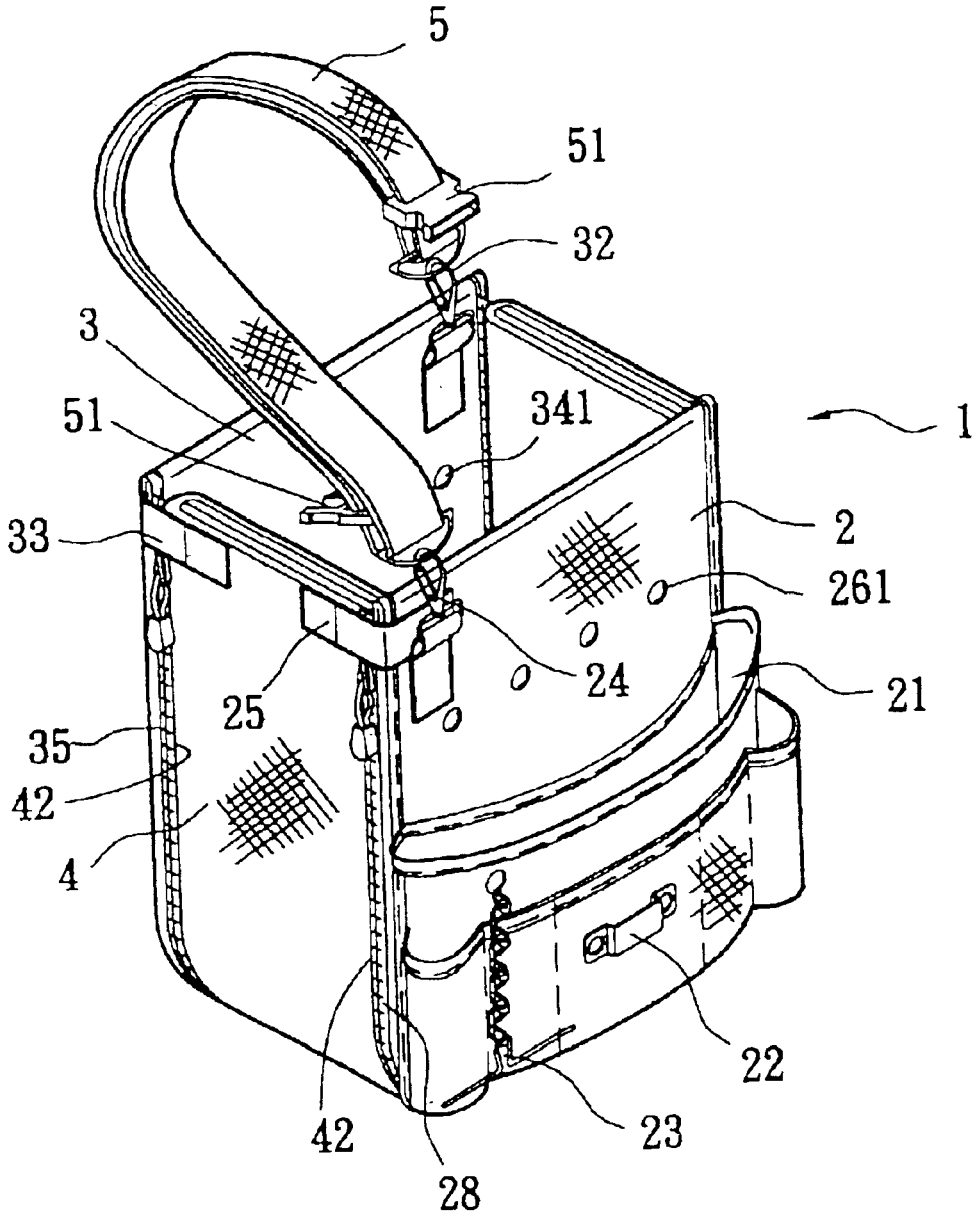
FIG. 3 is a perspective view of the tool bag of the present invention.
Figure 4:
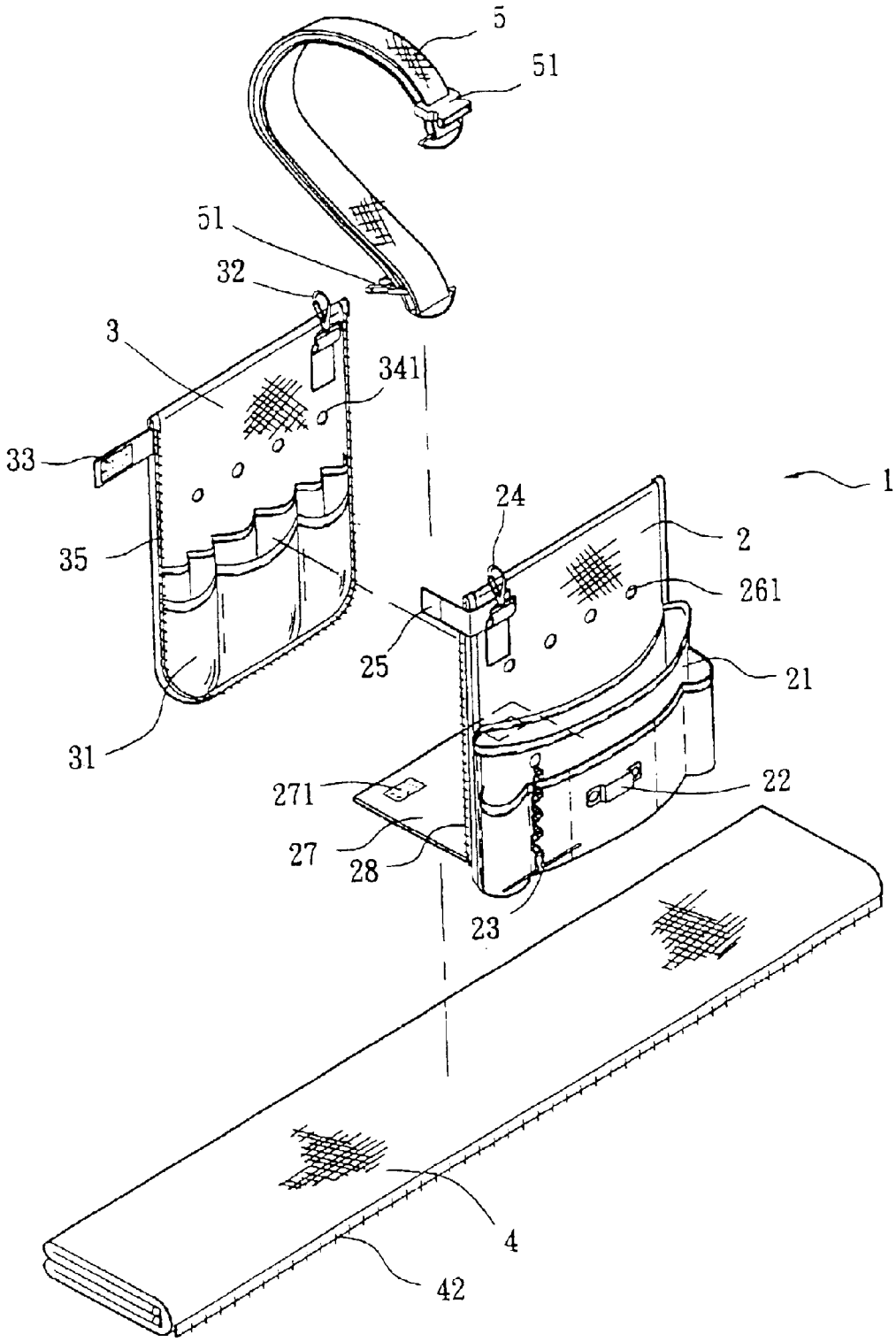
FIG. 4 is a perspective exploded view of FIG. 3 of the present invention.

Referring to FIGS. 2 and 3, there is shown a combination tool bag 1 comprising:

(a) a main tool pocket 2 having two bottom end and having a plurality of tool holding slots 21 for holding tools, such as pliers, hammers, wrench, etc the bottom at the center of the pocket 2 provided with a hook 22 for a retractable measuring tape, and an inverted T-shape hook 23 being positioned at a side of the hook 22 having an end portion being positioned at the pocket 2 using a rivet, the inverted T-shape hook 23 used for holding a rubber roll, and the left upper end of the pocket 2 being a hook section 24 and a VELCRO 25 having one end mounted to the pocket 2, the back section of the pocket 2 provided with a space 26 being formed by fabric extended from the pocket 2 and secured using rivets, the bottom section of the pocket 2 being provided with a pocket pad 27 which is a flat plate having one face thereof being fastened to the pocket 2 using a VELCRO, and a zipper 28 being provided to three side edges of the pocket 2;

(b) a secondary holding pocket 3 having a plurality of holding slots 31, and the right upper end of the pocket 3 being a hook section 32 and the left upper end being a VELCRO 33, wherein one end of the VELCRO 33 is fabricated within the pocket 3 body, and the pocket 3 is provided with a space 34 which is formed from the front of the pocket 3 to the rear face of the pocket 3 and a plurality of rivets are used for mounting, the three lateral sides of the pocket 3 are provided with a zipper 35, and (c) a folding pad 4 being a wide flat pad having one surface provided with a plurality of VELCRO tape 41, and the two lateral sides being provided with a zipper 42, (d) an adjustable back pocket 5 having two end hook portions to hook the hook portion 24, 32 of the two tool pockets 2, 3 to obtain a tool bag 1 which can be placed at the side of the user.

In view of the above structure, the tool bag 1 of the present invention comprises a main tool pocket 2, a secondary tool pocket 3, a folded pad 4 and an adjustable back pocket 5. The two pockets 2, 3 are placed at the front of the tool bag 1 and the folded pad 4 is positioned between the two pockets 2, 3. The zipper 28 of the tool pocket 2 and the zipper 42 of the folded pad 4 are engaged and are pulled along the edge till the terminal point, then the pocket 2 is combined at one side of the folded pad 4.

Figure 5:
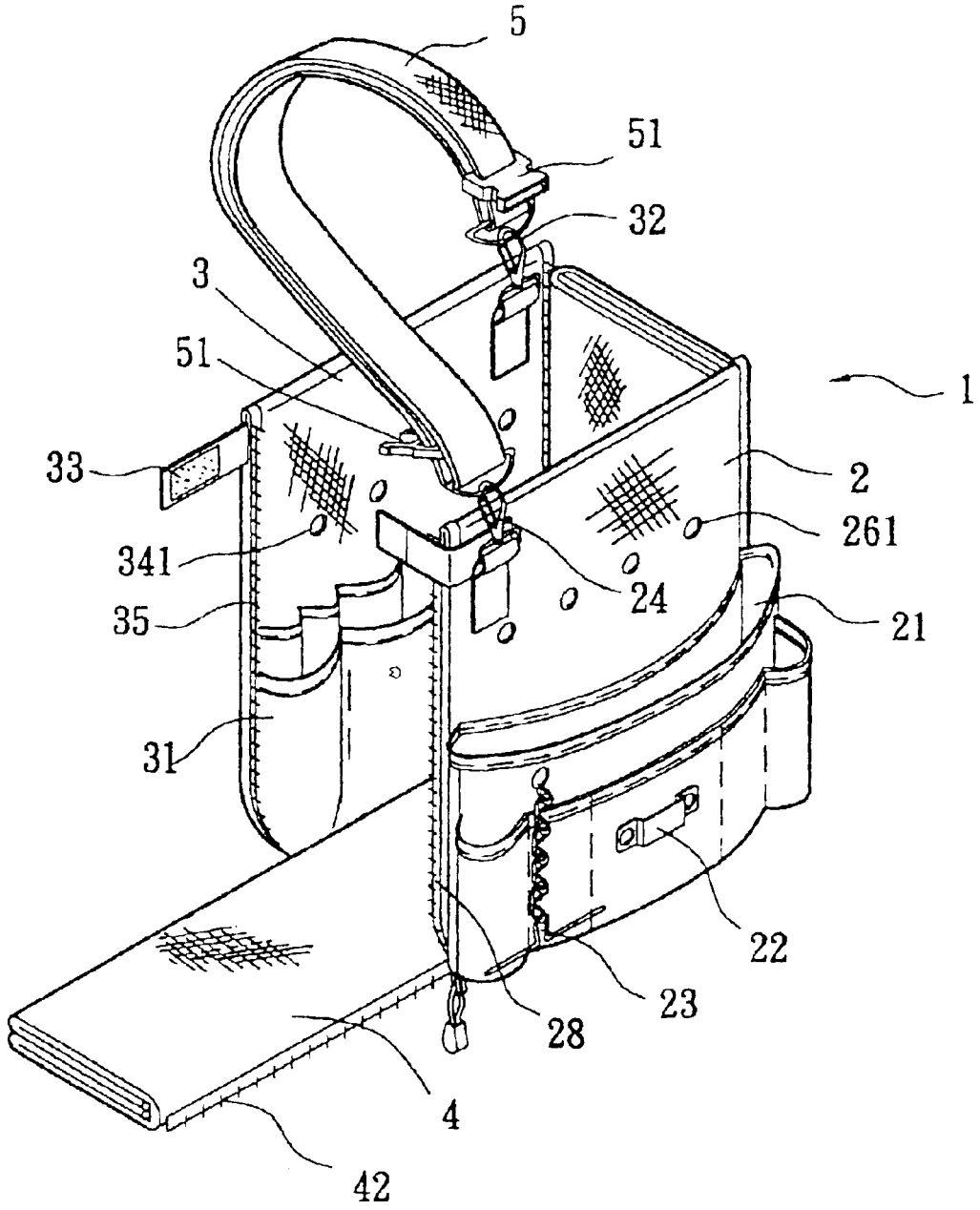
FIG. 5 is a partial extension view of FIG. 3, wherein the folded pad is pulled downward to a position.

The initial points of the zipper 35 of the pocket 3 is engaged with that of the zipper 42 of the folded pad 4, and are pulled along the edge of the pocket 3 till the terminal point, the pocket 3 is combined with the folded pad 4 (as shown in FIG. 5). Further, the VELCRO tape 25, 33 of the pocket 2 and the pocket 3 are adhered to the VELCRO tape 41 of the folded pad 4, a main body of the tool bag 1 is obtained. However after the combination of the pocket 3 and the folded pad 4, the front face of the pocket 3 includes a tool holding slot 31, and the rear pocket hook section 32 is positioned within the interior of the tool bag 1. The pocket pad 27 of the pocket 2 can be separated from the VELCRO tape 271 and is placed at the bottom of the bag 1 to enhance the strength of the bag to hold heavy tools.

The two end hook portions of the adjustable back pocket 5 hook the hook portions 24, 32 of the pockets 2, 3 so that the tool bag can be hung at the side of the users.

Figure 6:
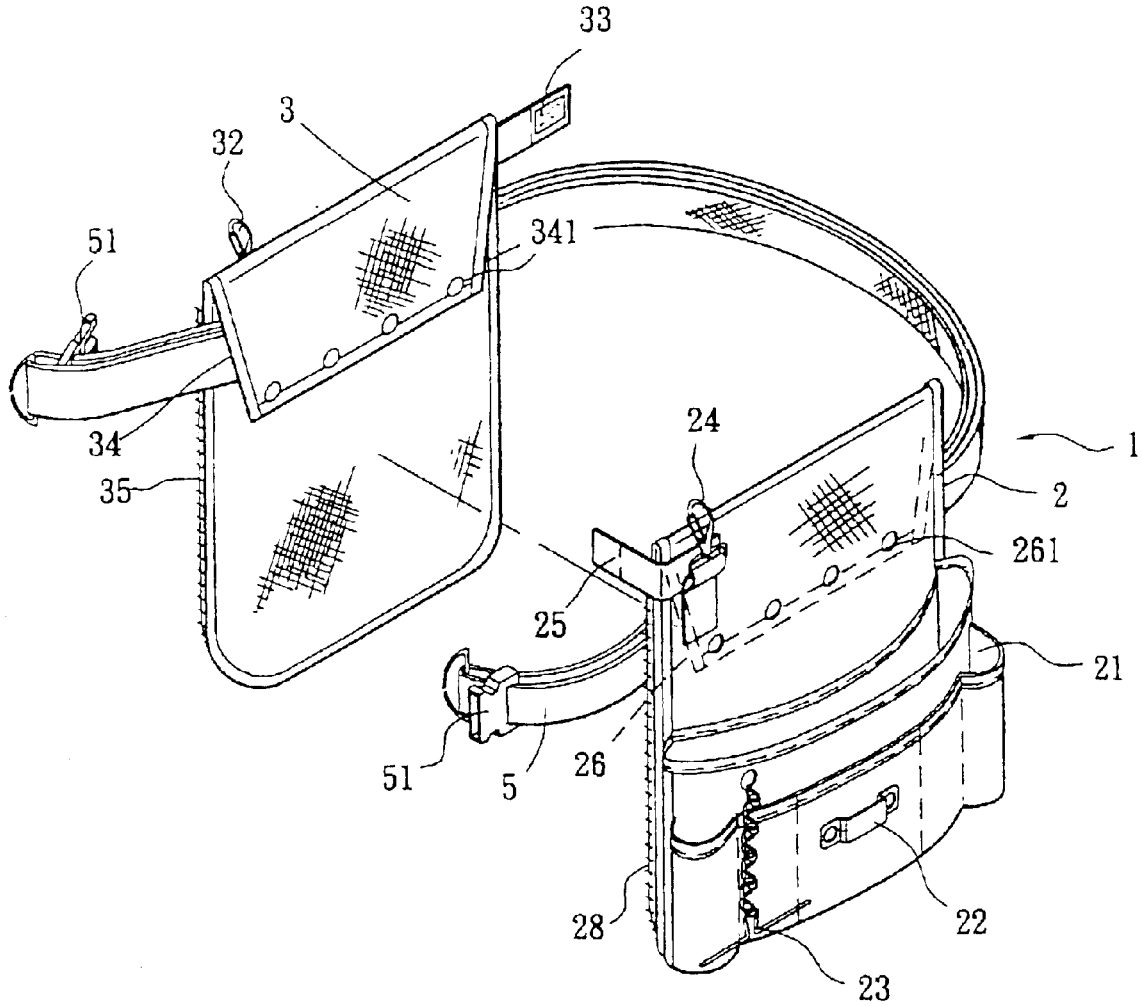
FIG. 6 is a perspective view of another preferred embodiment of the present invention.
Figure 7:
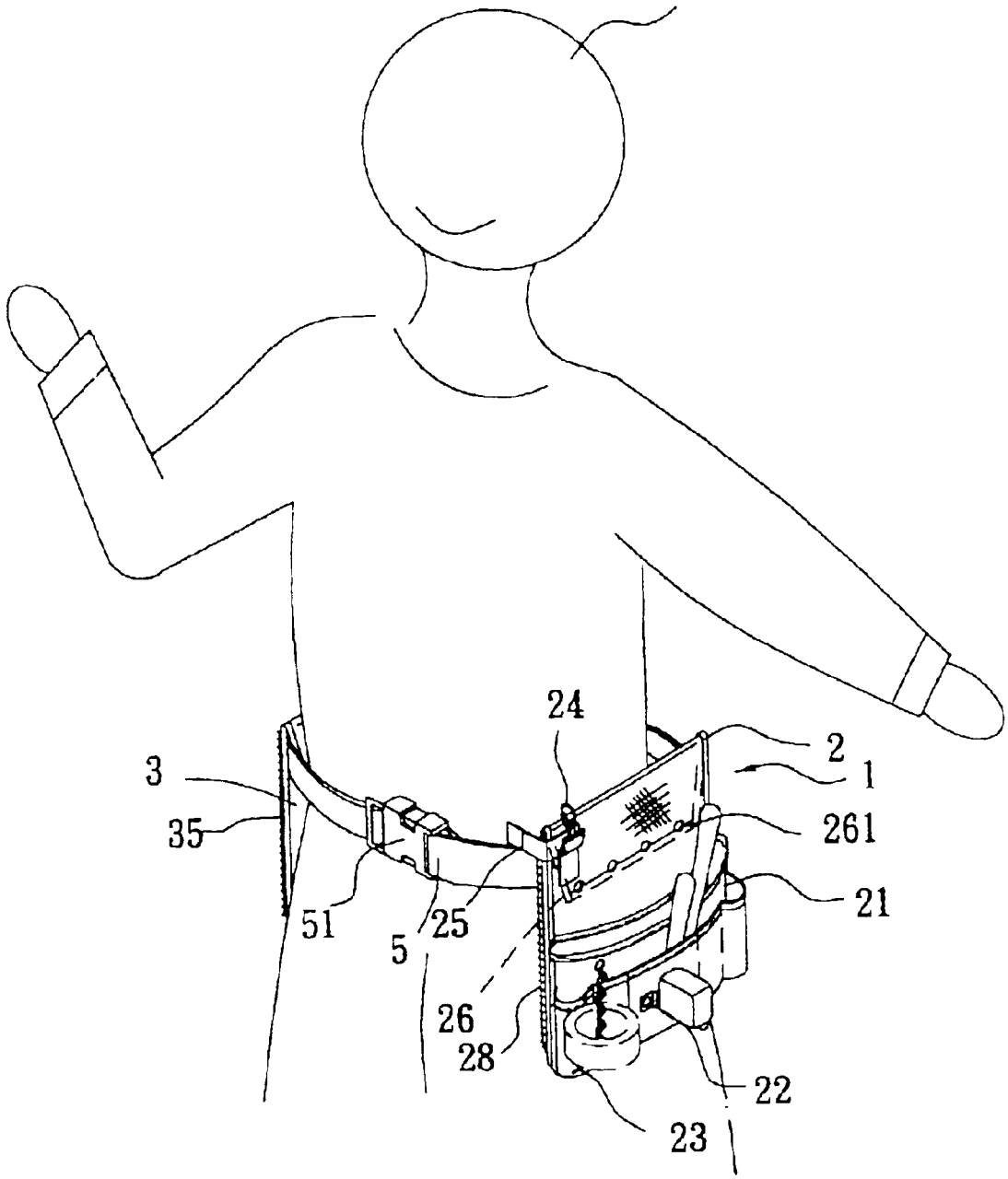
FIG. 7 shown an implementation of FIG. 6, wherein the tool bag is tied to the waist of the user.

Referring to FIGS. 6 and 7, the pockets 2, 3 are two plate body for mounting onto the waist of the user. The middle space 26, 34 are facing each other and the tool holding slots 21, 31 face externally. The adjustable back pocket 5 passes through the middle space 26, 34 of the pockets 2, 3 and surrounds the waist of the user. The insertion fastener 51 at the two ends of the back pocket 5 is fastened and the pockets 2, 3 are positioned at the lateral side of the user which facilitates the obtaining of the tools.

Figure 8:
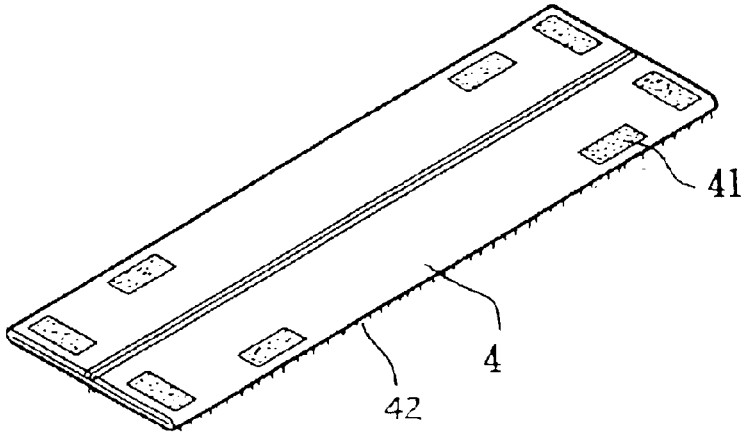
FIG. 8 is a partial extension view of the folded pad in accordance with the present invention.
Figure 9:
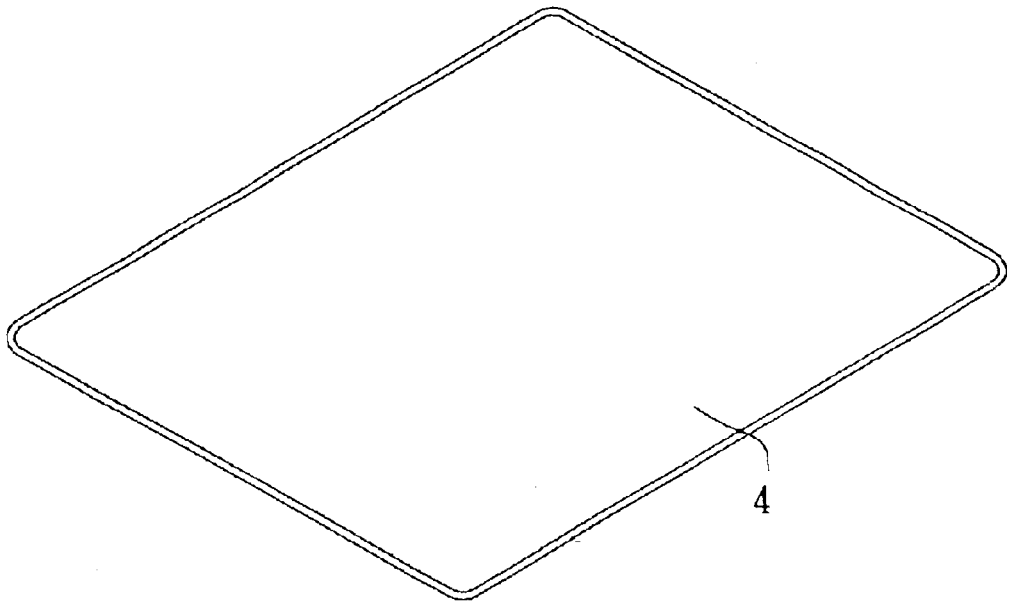
FIG. 9 is full extension view of FIG. 8 of the present invention.
Figure 10:
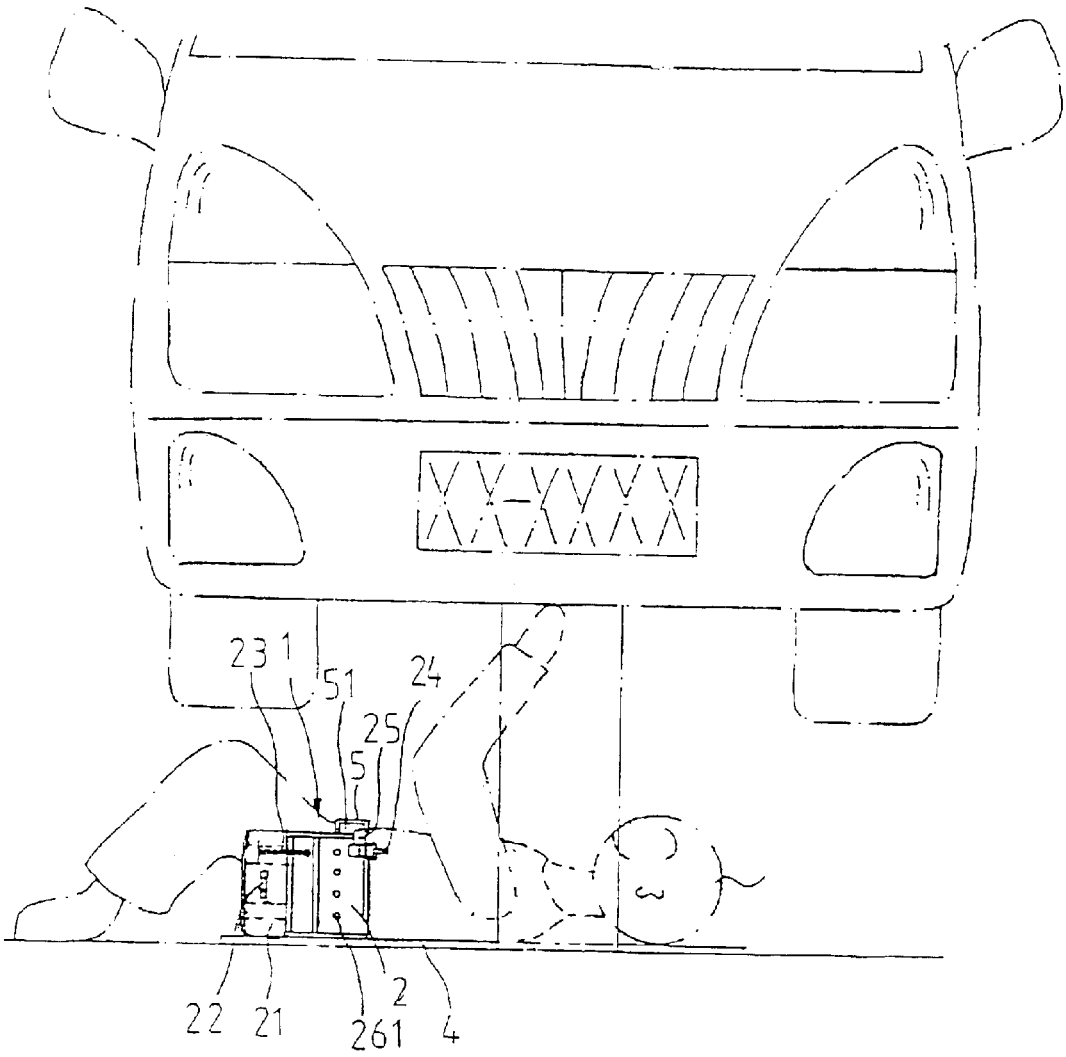
FIG. 10 is an implementation of FIG. 9 of the present invention.

Referring to FIGS. 8 and 9, the folded pad 4 is elongated and the pad 4 is provided with a plurality of VELCRO tape 41. The folded pad 4 can be extended so that the VELCRO tape 41 is positioned at the rear face to provide a back support when a user lays his back against the floor, as shown in FIG. 10.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A combination tool bag comprising:

(a) a main tool pocket having a plurality of tool holding slots for holding tools, a lower central portion of the main tool pocket being provided with a hook for receiving a retractable measuring tape thereon, the main tool pocket having an inverted T-shape hook coupled thereto by a rivet, an upper end of the main tool pocket having a first hook section and having a first hook and loop fastening element extending from the main tool pocket, the main tool pocket having a back section provided with a space formed by fabric extending from a front of the main tool pocket and secured to a rear side thereof by rivets, the main tool pocket having a bottom section formed by a flat plate having one face thereof releasably fastened to the main tool pocket using a second hook and loop fastening element, and the main tool pocket having a zipper extending along three side edges of the main tool pocket;

(b) a secondary holding pocket having a plurality of holding slots formed in a pocket body thereof, and one upper end portion of the secondary holding pocket having a second hook section and an opposing upper end portion having a third hook and loop fastening element, wherein one end of the third hook and loop fastening element is fabricated with the pocket body, the secondary holding pocket having a space formed by fabric extending from a front of the secondary holding pocket to the rear face thereof and secured by a plurality of rivets, the secondary holding pocket having three lateral sides provided with a zipper;

(c) a folding pad positionable between the main tool pocket and the secondary holding pocket and defined by a wide flat pad having one surface provided with a plurality of hook and loop fastening tape complementary to the first, second and third hook and loop fastening elements, the folding pad having two lateral sides respectively provided with zippers; and, (d) an adjustable strap having two end hook portions for respectively hooking the first and second hook sections in a tool bag configuration.

2. The combination tool bag of claim 1, wherein the adjustable strap is insertable through the space of the main tool pocket and the space of the secondary tool pocket for mounting the main tool pocket and the secondary tool pocket to a user's waist.

3. The combination tool bag of claim 1, wherein the tool holding slots of the main tool pocket and the secondary holding pocket are of different sizes to accommodate different tools.

* * * * *